US011815298B2

(12) United States Patent
Long

(10) Patent No.: US 11,815,298 B2
(45) Date of Patent: Nov. 14, 2023

(54) COMBINED AIR CONDITIONING AND WATER HEATING VIA EXPANSION VALVE REGULATION

(71) Applicant: Rheem Manufacturing Company, Atlanta, GA (US)

(72) Inventor: Robert L. Long, Fort Smith, AR (US)

(73) Assignee: Rheem Manufacturing Company, Atlanta, GA (US)

( * ) Notice: Subject to any disclaimer, the term of this patent is extended or adjusted under 35 U.S.C. 154(b) by 142 days.

(21) Appl. No.: 17/350,065

(22) Filed: Jun. 17, 2021

(65) Prior Publication Data

US 2022/0404075 A1 Dec. 22, 2022

(51) Int. Cl.

| | |
|---|---|
| ***F25B 41/34*** | (2021.01) |
| ***F25B 41/385*** | (2021.01) |
| ***F24F 1/022*** | (2019.01) |
| ***F24H 1/52*** | (2022.01) |
| ***F24H 9/14*** | (2006.01) |

(Continued)

(52) U.S. Cl.

CPC ..... *F25B 41/34* (2021.01); *F24F 1/022* (2013.01); *F24H 1/52* (2013.01); *F24H 9/144* (2013.01); *F25B 41/385* (2021.01); *F24F 1/0323* (2019.02); *F24F 1/0326* (2019.02);

(Continued)

(58) Field of Classification Search

CPC ..... F25B 41/34; F25B 41/385; F25B 2600/2513; F25B 49/02; F25B 6/02; F24F 1/022; F24F 1/0323; F24F 1/0326; F24F 11/65; F24F 2110/10; F24F 2110/12;

(Continued)

(56) References Cited

U.S. PATENT DOCUMENTS 11,175,074 B1 * 11/2021 Bush ..... F25B 49/02
2007/0051119 A1 3/2007 Hayashi et al.

(Continued)

FOREIGN PATENT DOCUMENTS

CN 106123260 A * 11/2016 ..... F24F 12/00
CN 106524349 A * 3/2017

(Continued)

OTHER PUBLICATIONS

The International Search Report and the Written Opinion of International Application No. PCT/US2022/032488 dated Sep. 16, 2022.

*Primary Examiner* — Kun Kai Ma

(74) *Attorney, Agent, or Firm* — Eversheds Sutherland (US) LLP

(57) ABSTRACT

A combination water heating, air conditioning refrigerant system is described. The combined system includes a plurality of independently adjustable electronic expansion valves. The expansion valves can independently modulate the delivery of high-temperature, high-pressure refrigerant to either a water heat exchanger or an outside condenser. A controller can receive input signals, including temperature signals from one or more temperature sensors that indicate the temperature at various locations of the system. The temperature signals include one or more of water temperature signals, ambient air temperature signals, or refrigerant super heat temperatures signals. In response to the input signals, the controller can output control signals to one or more of the plurality of electronic expansion valves.

20 Claims, 5 Drawing Sheets

(51) Int. Cl.

| | |
|---|---|
| ***F24F 11/65*** | (2018.01) |
| ***F24F 110/12*** | (2018.01) |
| ***F24F 1/0326*** | (2019.01) |
| ***F24F 1/0323*** | (2019.01) |

(52) U.S. Cl.
CPC ..... *F24F 11/65* (2018.01); *F24F 2110/12* (2018.01); *F25B 2600/2513* (2013.01)

(58) Field of Classification Search
CPC ..... F24H 1/52; F24H 9/144; F24H 15/223; F24H 15/227; F24H 15/385; F24H 11/84
See application file for complete search history.

(56) References Cited

U.S. PATENT DOCUMENTS

| | | | | |
|---|---|---|---|---|
| 2015/0285539 | A1 | 10/2015 | Kopko | |
| 2015/0330675 | A1 | 11/2015 | Tamaki et al. | |
| 2022/0163241 | A1* | 5/2022 | Kim | F25B 49/02 |

FOREIGN PATENT DOCUMENTS

| | | | | | |
|---|---|---|---|---|---|
| CN | 111288676 | A | * | 6/2020 | F25B 41/20 |
| JP | 08049924 | A | * | 2/1996 | |
| KR | 20190081837 | A | * | 9/2019 | |

* cited by examiner

COMBINED AIR CONDITIONING AND WATER HEATING VIA EXPANSION VALVE REGULATION

FIELD OF THE DISCLOSURE

Examples of the present disclosure relate generally to combined air conditioning and water heating systems and, more specifically, to combined systems that can independently regulate refrigerant flow using a plurality of independently adjustable electronic expansion valves.

BACKGROUND

In a conventional heat-pump regulated air conditioning system, air cooling is facilitated by an evaporator and a condenser system that work in tandem to remove heat from an interior space of a building and dump the heat to the outside of the building. The evaporator is used to draw heat from internal air flow, for example by transferring the heat to refrigerant in the system. The low-pressure vapor exiting the evaporator can then be compressed by a compressor, and the high-pressure, high-temperature refrigerant is then routed to the condenser positioned outside. The heat from the vaporized refrigerant is then dissipated outside the building, and the sub-cooled refrigerant can return to the evaporator to repeat the process.

Recently, manufacturers have sought ways to combine air-conditioning and water-heating subsystems into a single, integrated unit. For example, instead of routing the high-pressure, high-temperature refrigerant to the outside condenser and merely lose that heat, certain systems have aimed to re-route that heated refrigerant to a water heat exchanger to heat potable water. Although this is a more efficient approach than merely expelling the refrigerant's heat outdoors, certain inefficiencies are found in present dual-purpose systems. Perhaps most significant is the fact that prior systems are typically binary in nature—the high-temperature refrigerant leaving the compressor is either routed to the outside compressor or the water heat exchanger, but not both. This can be attributed to the fact that existing designs generally include a three-way valve placed in series after the compressor to route the refrigerant to either the condenser or the water heat exchanger. To this end, if hot water is in demand, heat is not expelled to the outside condenser; if air conditioning is in demand, heat is not routed to the water heat exchanger. What is needed, therefore, is a system that can efficiently combine air conditioning and water heating.

BRIEF SUMMARY

These and other problems can be addressed by the technologies described herein. Examples of the present disclosure relate generally to combined air conditioning and water heating systems and, more specifically, combined systems that can independently regulate refrigerant flow using a plurality of independently adjustable electronic expansion valves.

The present disclosure provides a combined air-cooling and water-heating system. The system can include a first electronic expansion valve in fluid communication with a condenser coil at a first end and an evaporator coil at a second end. The first electronic expansion valve can transition between an open configuration, a closed configuration, and an intermediate configuration between the open configuration and the closed configuration. The system can include a second electronic expansion valve in fluid communication with a water heat exchanger at a first end and the evaporator coil at a second end. The second electronic expansion valve can transition between an open configuration, a closed configuration, and an intermediate configuration between the open configuration and the closed configuration. The system can include a controller configured to output one or more control signals to the first electronic expansion valve and the second electronic expansion valve to transition the respective valves between the open and closed configurations.

The system can output control signals to the first electronic expansion valve in response to determining an increased demand for air conditioning; the system can output control signals to the second electronic expansion valve in response to determining an increased demand for water heating. Various temperature and/or pressure sensors can be included in the system to determine when the respective expansion valves should be modulated. For example, the system can include a temperature sensor configured to detect ambient air temperature and output a temperature signal to the controller. The controller can output a control signal in response to determining the ambient air temperature is above a predetermined temperature. The control signal can instruct the first electronic expansion valve to open at least partially. At least partially opening the first electronic expansion valve can increase refrigerant flow through the condenser coil.

The system can include a temperature sensor that can detect water temperature of a water storage tank and output a temperature signal to the controller. The controller can output a control signal further in response to determining the water temperature is below a predetermined temperature. The control signal can instruct the second electronic expansion valve to open at least partially. At least partially opening the second electronic expansion valve can increase refrigerant flow through the water heat exchanger.

The system can include a compressor in fluid communication with (i) the evaporator coil at a first end and (ii) the condenser coil and the water heat exchanger at a second end. The system can include a temperature sensor positioned within a refrigerant circuit between the evaporator coil and the compressor. The temperature sensor can detect a temperature of a refrigerant exiting the evaporator coil, and output a temperature signal to the controller in response to the temperature of the refrigerant being below a predetermined temperature. The one or more control signals can transition at least one of the first electronic expansion valve or the second electronic expansion valve to an at least partially open configuration to increase the temperature of the refrigerant exiting the evaporator coil.

The system can include a pressure sensor positioned within the refrigerant circuit between the evaporator coil and the compressor. The pressure sensor can detect a pressure of the refrigerant exiting the evaporator coil, and output a pressure signal to the controller in response to the pressure of the refrigerant being below a predetermined value. The one or more control signals can transition at least one of the first electronic expansion valve or the second electronic expansion valve to an at least partially open configuration to increase the pressure of the refrigerant exiting the evaporator coil.

The system can include a compressor in fluid communication with (i) the evaporator coil at a first end and (ii) the condenser coil and the water heat exchanger at a second end. A refrigerant flow path between the compressor and (a) the condenser coil and (b) the water heat exchanger can include a valve-free splitter.

The present disclosure provides a water heating and air conditioning system. The system can include a compressor, an evaporator coil, a condenser coil in fluid communication with the compressor at a first end the evaporator coil at a second end, a water heat exchanger in fluid communication with the compressor at a first end the evaporator coil at a second end, a first electronic expansion valve disposed in series between the condenser coil and the evaporator coil, and a second electronic expansion valve disposed in series between the water heat exchanger and the evaporator coil. The first electronic expansion valve and the second electronic expansion valve can be independently transitionable between open and closed configurations or any intermediate point therebetween such that refrigerant flow through the condenser coil and/or water heat exchanger is independently regulatable.

The system can further include a controller that can output one or more control signals to the first electronic expansion valve and/or the second electronic expansion valve to transition the respective electronic expansion valve between the open and closed configurations in response to an increased demand for air conditioning and/or an increased demand for water heating. The system can further include the temperature and/or pressure sensors described above.

The present disclosure also describes the controller in greater detail and provides methods of controlling the systems described herein using the controller. These and other aspects of the present disclosure are described in the Detailed Description below and the accompanying figures. Other aspects and features of the present disclosure will become apparent to those of ordinary skill in the art upon reviewing the following description of specific examples of the present disclosure in concert with the figures. While features of the present disclosure may be discussed relative to certain examples and figures, all examples of the present disclosure can include one or more of the features discussed herein. Further, while one or more examples may be discussed as having certain advantageous features, one or more of such features may also be used with the various other examples of the disclosure discussed herein. In similar fashion, while examples may be discussed below as devices, systems, or methods, it is to be understood that such examples can be implemented in various devices, systems, and methods of the present disclosure.

BRIEF DESCRIPTION OF THE DRAWINGS

The accompanying drawings, which are incorporated in and constitute a part of this specification, illustrate multiple examples of the presently disclosed subject matter and serve to explain the principles of the presently disclosed subject matter. The drawings are not intended to limit the scope of the presently disclosed subject matter in any manner. In the drawings.

DETAILED DESCRIPTION

Figure 1:
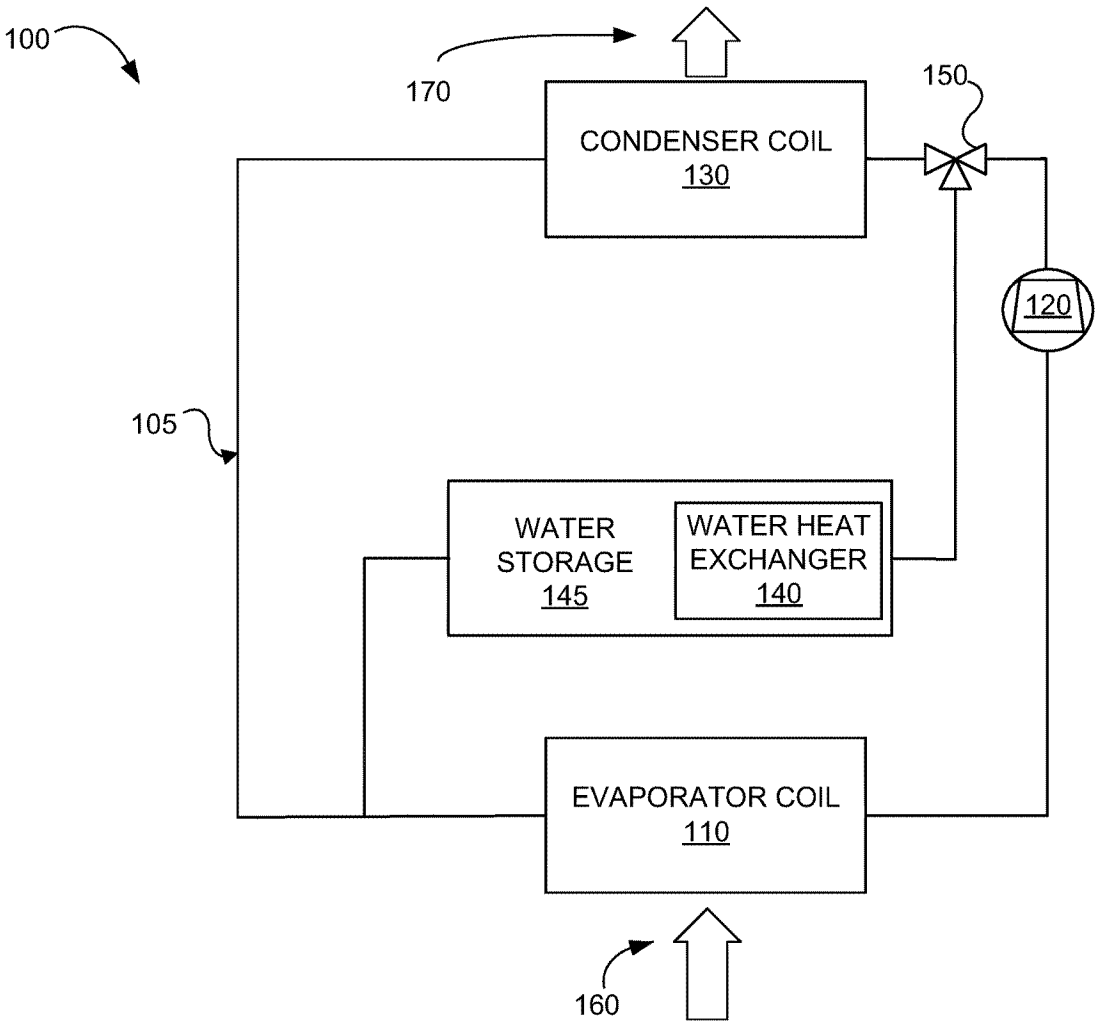
FIG. 1 (Prior Art)
FIG. 1 is a schematic of a prior art combined air conditioning and water heating system.

As the water and space cooling industry strives to create more efficient, greener, more cost-effective heating systems, manufacturers have turned to combining systems to share heat transfer loads. One such combination includes an air-conditioning and water heating system that utilizes a heat pump to both transfer heat to an outside compressor and a water heat exchanger. FIG. 1 is an example schematic of a prior art combined air conditioning and water heating system 100. The system includes a refrigerant circuit 105 that provides refrigerant to an evaporator coil 110, a compressor 120, a condenser coil 130, and a water heat exchanger 140. As indoor airflow 160 passes across the indoor evaporator coil 110, heat is transferred to the refrigerant in the refrigerant circuit 105. The low-pressure vaporized refrigerant is then routed to the compressor 120, where it is further compressed into a high-pressure vaporized phase. The high pressure vaporized refrigerant can then be routed to a three-way valve 150 that enables the refrigerant to be sent to either the outdoor condenser coil 130 or the water heat exchanger 140. If sent to the condenser coil 130, the heat of the high-pressure vaporized refrigerant is dissipated into outdoor airflow 170, which cools the refrigerant to a sub-cooled liquid before it passes back to the indoor evaporator coil 110. If the high-pressure vaporized refrigerant from the compressor 120 is sent to the water heat exchanger 140, the heat of the high-pressure vaporized refrigerant is transferred into water stored in water storage 145 (e.g., a water storage tank), which cools the refrigerant to a sub-cooled liquid before it passes back to the indoor evaporator coil 110.

A limitation of the prior-art design shown in FIG. 1 is the binary nature of the three-way valve 150. For example, a typical combination air-conditioning, water-heating system uses an expensive, non-modulating valve that enables the refrigerant to either be routed to the condenser coil 130 or the water heat exchanger 140, but not to both simultaneously. As can be appreciated, this is not an optimal configuration for a combined air conditioning and water heating system 100. To illustrate, if the combined system 100 is set to cooling mode, where the refrigerant is being routed to the outdoor condenser coil 130 to dissipate heat, the system does not provide heat to the water heat exchanger 140. Alternatively, if the combined system 100 is set to water heating mode, the refrigerant is being routed only to the water heat exchanger 140, meaning the heat is not being dissipated to the condenser coil 130, thereby degrading the ability to provide air conditioning. Further, because the prior art combined system 100 is binary, it is more difficult to monitor, modulate, and/or maintain the superheat of the refrigerant that exits the evaporator coil 110. For example, if the combined system 100 is in water heating mode, the temperature of the refrigerant entering the evaporator coil 110 may be lower than if the combined system 100 is in air conditioning mode. The prior systems did not provide an option to independently modulate refrigerant flow into the condenser coil 130 versus the water heat exchanger 140 to maintain an appropriate superheat (e.g., between 8° F. and 12° F.).

Referring again to the three-way valve 150 that enables the refrigerant to be sent to either the outdoor condenser coil 130 or the water heat exchanger 140, the placement of the valve within the refrigerant circuit 105 limits the ability to use a non-binary valve. The three-way valve 150 is placed serially after the compressor 120, such that the refrigerant flowing through the three-way valve 150 is significantly high-temperature and high-pressure. This is a contributing factor for using a binary valve (e.g., one path or the other), because the valve can be simple yet robust enough to handle the high temperature vaporized refrigerant. To use a non-binary valve would be contraindicated since such a valve would degrade significantly over time and would otherwise be significantly cost prohibitive (based on products available at the time of filing).

The present disclosure provides a solution to the binary nature of prior art combined systems. Instead of placing a three-way valve between the compressor and the water heat exchanger/condenser coil split, the disclosed system utilizes independent electronic expansion valves placed after the condenser coil and the water heat exchanger, respectively, and before the evaporator coil 110. The electronic expansion valves can be independently modulated to enable refrigerant flow through the condenser coil and/or evaporator coil. Further, since electronic expansion valves are placed in the refrigerant circuit where the refrigerant is a sub-cooled liquid, the chance of degrading the system over time is substantially lessened, as compared to the prior art combined systems. Various systems and methods are disclosed for combined systems that can independently regulate refrigerant flow using a plurality of independently adjustable electronic expansion valves, and example systems will now be described with reference to the accompanying figures.

Figure 2:
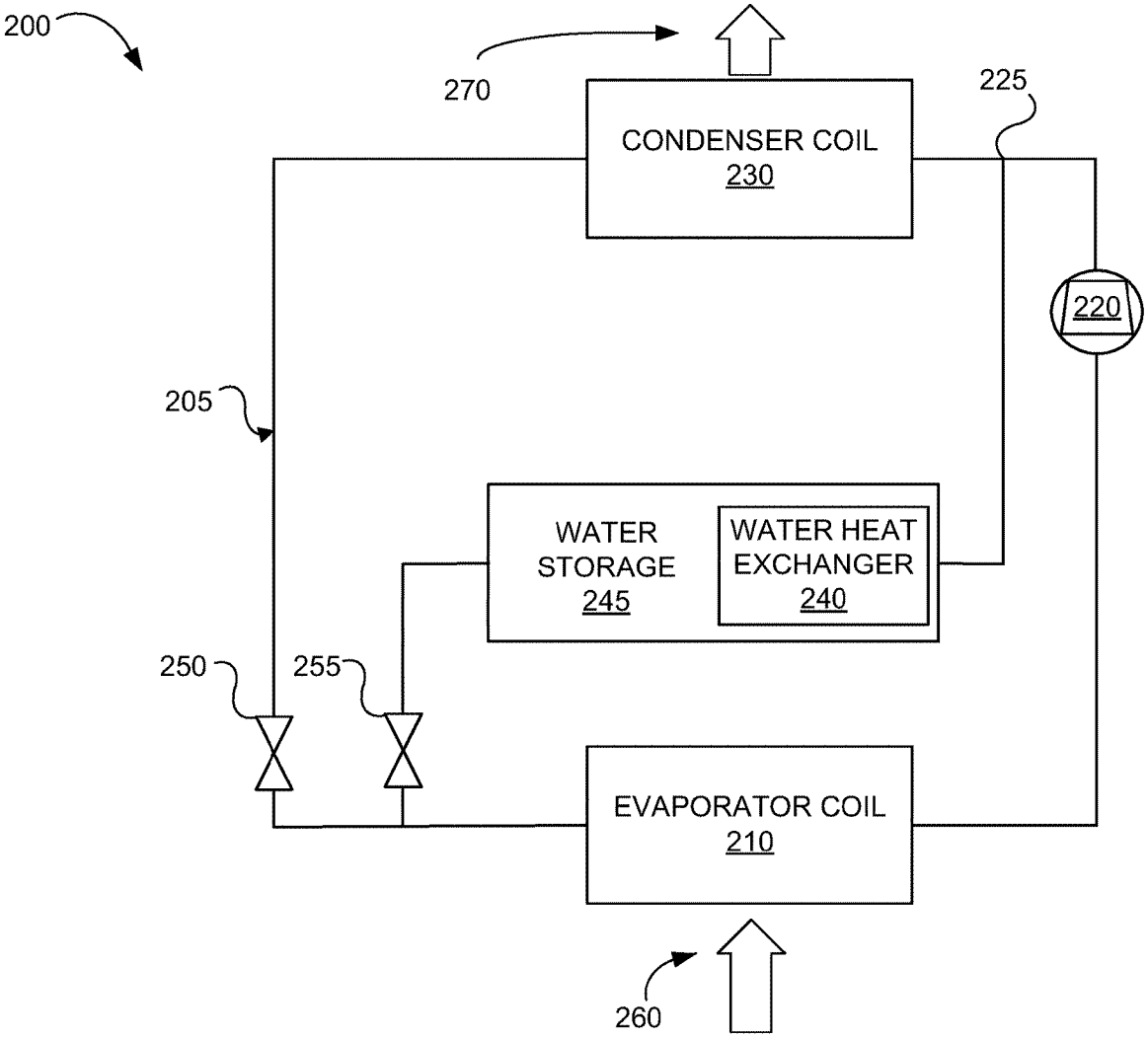
FIG. 2 is a schematic of a combined air conditioning and water heating system, according to the present disclosure.

FIG. 2 is a schematic of a combined air conditioning and water heating system 200, according to the present disclosure. The combined system 200 can include a refrigerant circuit 205 that provides refrigerant to an evaporator coil 210, a compressor 220, a condenser coil 230, and a water heat exchanger 240. The water heat exchanger 240 can be a condenser tube, a brazed plate heat exchanger, and the like. As indoor airflow 260 passes across the indoor evaporator coil 210, heat can be transferred to the refrigerant in the refrigerant circuit 205. The low-pressure vaporized refrigerant can then be routed to the compressor 220, where it can be further compressed into a high-pressure vaporized phase. The high pressure vaporized refrigerant can then be routed to a valve-free splitter 225. For example, instead of having a three-way valve (e.g., three-way valve 150 in FIG. 1), the flow path of the refrigerant circuit 205 between the compressor 220 and (a) the water heat exchanger 240 and (b) the condenser coil 230 can be valveless and merely include a line split (e.g., splitter 225) to either the water heat exchanger 240 or the condenser coil 230. In series after the condenser coil 230 and before the evaporator coil 210, the combined system 200 can include a first electronic expansion valve 250 (hereinafter "first EEV 250"). In series after the water heat exchanger 240 and before the evaporator coil 210, the combined system 200 can include a second electronic expansion valve 255 (hereinafter "second EEV 255").

During normal, full air cooling operation, the combined system 200 can operate like a standard air conditioning unit with the refrigerant entering the evaporator coil 210 from the first EEV 250. After the evaporator coil(s) 210 removes heat from the return air stream (evaporates the two-phase refrigerant into a superheated vapor), the compressor 220 can raise the refrigerant pressure and temperature. The heat from the compressor 220 can then be rejected in the outside condenser coil 230 via outdoor airflow 270, and condensed to a liquid where it again enters the first EEV 250, and the cycle can start again. The second EEV 255 can be completely closed during this mode so no refrigerant flows through the water heat exchanger 240 or the second EEV 255, although refrigerant charge can be stored in the water heat exchanger 240 and/or the refrigerant line between the splitter 225 and the second EEV 255.

During full water heating mode, the first EEV 250 can be completely closed, the refrigerant can flow through the water heat exchanger 240 (instead of the condenser coil 230), and refrigerant can flow through the second EEV 255 to the evaporator coil 210. An outdoor fan can be switched off during full water heating mode to preserve energy since the outdoor condenser coil 230 is not being utilized in this example.

When the unit is in modulating water heating mode, the controls of the combined system 200 can be designed such that one of the electronic expansion valves can be opened to a fixed position while the other valve is used to control the superheat at the outlet of the evaporator coil 210. For example, when only a small amount of water heating is required, the combined system 200 can open the second EEV 255 slightly to an intermediate configuration between fully open and fully closed configurations so that a small amount of refrigerant is metered through. The first EEV 250 can have a full range of operation necessary to control the superheat at the evaporator coil 210 outlet. When a large amount of water heating is required (e.g., more than 60%), the operation of the electronic expansion valves can be reversed. In this case the first EEV 250 can be opened slightly by the controls (e.g., to any of a plurality of intermediate configurations), while the second EEV 255 can provide a full range of operation necessary to control the superheat at the evaporator outlet. The outdoor fan speed can also be modulated to help control the amount of heat rejection at the outdoor condenser coil 230. A unit controller (e.g., controller 400) can be programmed to control position of the "fixed" expansion valve during modulating water heating mode. To illustrate using a non-limiting example, if the system is in full cooling mode and first EEV 250 is maintaining superheat, second EEV 255 can open to 5% of the prior flow of first EEV 250 with second EEV 250 reducing its flow to maintain superheat.

Figure 3:
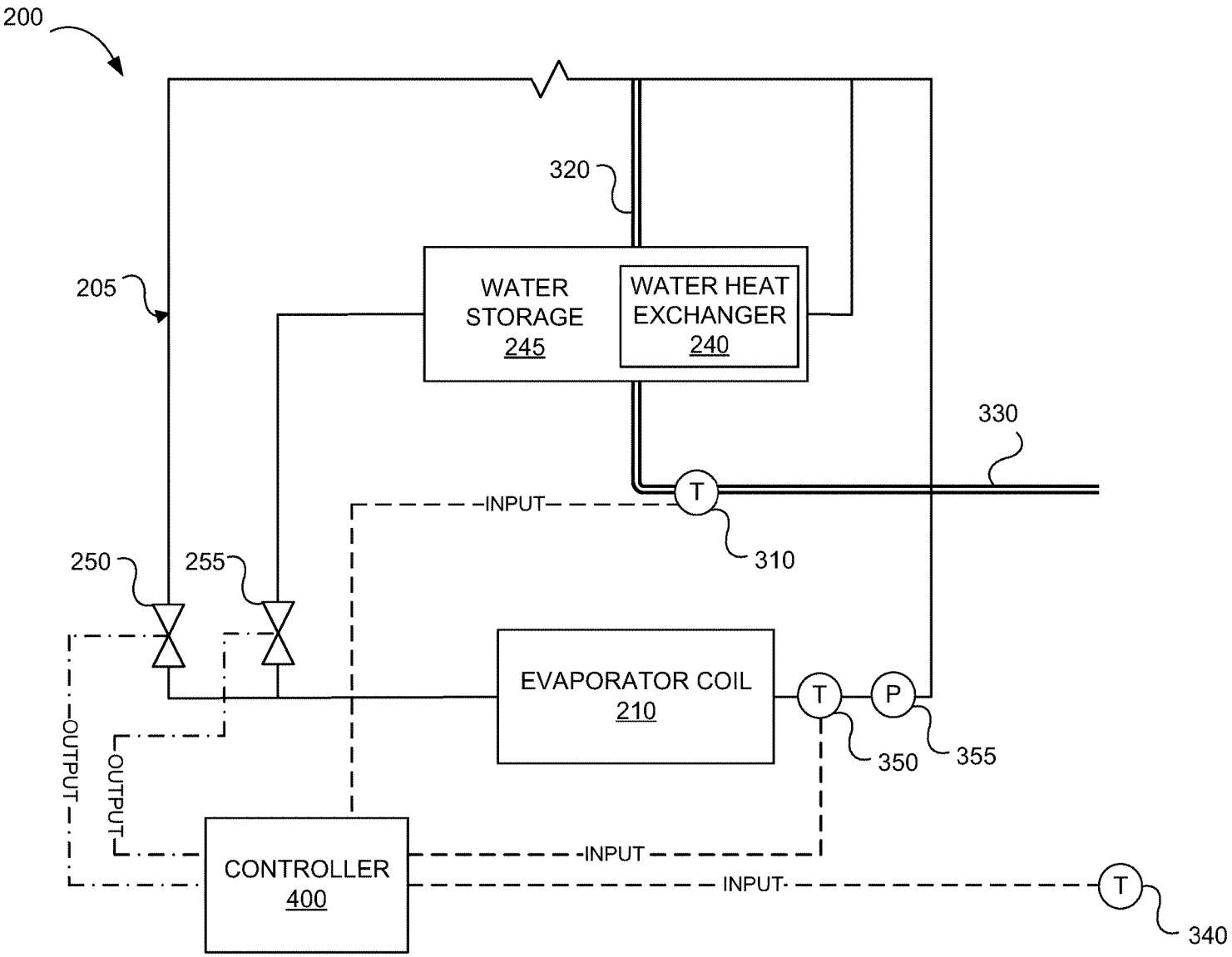
FIG. 3 is a schematic of a control system for a combined air conditioning and water heating system, according to the present disclosure.

FIG. 3 is a schematic of a control system for a combined air conditioning and water heating system 200, according to the present disclosure. The control system can include a controller 400 that can output control signals to the first EEV 250 and/or the second EEV 255. The control signals can be transmitted to the respective EEVs in response to the controller 400 receiving an indication of temperatures at various locations of and around the combined system 200. These indications of temperatures, or temperature signals, can be transmitted to the controller 400 from one or more temperature sensors that can detect the refrigerant temperature within the refrigerant circuit and/or temperature of the heating/cooling of the combined system 200, as dictated by demand.

The system can include a first temperature sensor 310 (i.e., a water temperature sensor) positioned to detect temperature of the water leaving the water storage tank 245 and/or stored within the water storage tank 245. For example, the water storage tank 245 can include a cool-water inlet 320 (which brings non-heated water into the tank) and a heated-water outlet 330 (which supplies heated water to the building upon demand). The first temperature sensor 310 can be positioned along the heated-water outlet 330 and/or within the water storage tank 245 to detect the temperature of the stored water. If the water falls below a predetermined temperature (e.g., around 120° F.), it can be determined that hot water is in demand. In this case, the first temperature sensor 310 can output a temperature signal (e.g., a water temperature signal) to the controller 400 indicating hot water is in demand and that the temperature of water stored within the water storage tank 245 is dropping with use. In response, the controller 400 can output a control signal to the second EEV 255 instructing the valve to open at least partially and meter additional heated refrigerant through the water heat exchanger 240. As described above, the second EEV 255 can be metered in this example regardless of the setting of the first EEV 250, thus not affecting the air conditioning provided via the condenser coil 230/evaporator coil 210 circuit.

The system can include a second temperature sensor 340 (i.e., an ambient air temperature sensor) positioned to detect temperature of the ambient air within a space to be cooled via air conditioning. This second temperature sensor 340 can be similar to or include an internal thermostat used for control of the air conditioning. If the ambient air raises above a predetermined temperature (e.g., 70° F. or whatever the air conditioning may be set to), it can be determined that air conditioning is in demand. In this case, the second temperature sensor 340 can output a temperature signal (e.g., an ambient air temperature signal) to the controller 400 indicating air conditioning is in demand. In response, the controller 400 can output a control signal to the first EEV 250 instructing the valve to open at least partially and meter additional heated refrigerant through the outdoor condenser coil 230. As described above, the first EEV 250 can be metered in this example regardless of the setting of the second EEV 255, thus not affecting the hot water provided via the water heat exchanger 240/evaporator coil 210 circuit.

The system can include a third temperature sensor 350 (e.g., a refrigerant superheat temperature sensor) positioned to detect the temperature of refrigerant in the refrigerant circuit 205 as it exits the evaporator coil 210. As stated above, the first EEV 250 and the second EEV 255 can be metered independently, one being fixed while the other is modulated, or both being modulated simultaneously. That said, the temperature of the refrigerant exiting the evaporator coil 210 can be modulated by opening and/or closing either of the valves independently. For example, if the temperature of the refrigerant exiting the evaporator coil 210 falls below a predetermined superheat temperature (e.g., between 8° F. and 12° F.), the third temperature sensor 350 can output a refrigerant temperature signal to the controller to modulate the superheat. In response, the controller 400 can output a control signal to one or both of the first EEV 250 or the second EEV 255 instructing at least one of the valves to open at least partially and meter additional heated refrigerant through that particular circuit. If hot water is in demand, the control signal can instruct the second EEV 255 to open more; if air conditioning is in demand, the control signal can instruct the first EEV 250 to open more; if both air conditioning and hot water are in demand, the control signal can instruct both valves to open more. It is also contemplated that the third temperature sensor 350 can be positioned at the evaporator coil 210.

In addition to or as an alternative to the third temperature sensor 350 (i.e., a refrigerant superheat temperature sensor) described above, the control system of the combined system 200 can include a pressure sensor 355. The pressure sensor 355 can be positioned in series between the evaporator coil 210 and the compressor 220. The pressure sensor 355 can detect a refrigerant pressure exiting the evaporator coil 210. If the pressure in the circuit is below a predetermined pressure, this can indicate to the controller 400 that the superheat is dropping after the evaporator coil 210. The pressure sensor 355 can send a pressure signal to the controller 400 and, in response the controller 400 can output a control signal to one or both of the first EEV 250 or the second EEV 255 instructing at least one of the valves to open at least partially and meter additional heated refrigerant through that particular circuit. If hot water is in demand, the control signal can instruct the second EEV 255 to open more; if air conditioning is in demand, the control signal can instruct the first EEV 250 to open more; if both air conditioning and hot water are in demand, the control signal can instruct both valves to open more. The temperature and pressure sensors described herein can be in wired or wireless communication with the controller 400.

Any of the temperature sensors described herein (e.g., first temperature sensor 310, second temperature sensor 340, and/or third temperature sensor 350) can be thermometers, thermocouples, thermistors, and the like. It will be understood that referring to a sensor as a first, second, third, etc. sensor does not mean that any of the sensors are arranged in a particular order or that any of the sensors are required. The combined system 200 described herein can include any one or all of the sensors. Reference to a first, second, third, etc. merely provides a means to differentiate particular sensors.

Figure 4:
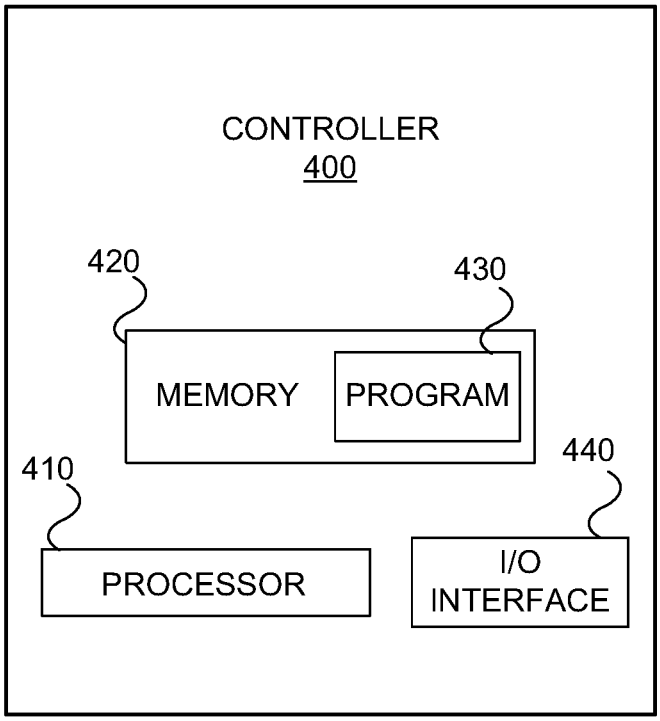
FIG. 4 is a component diagram of an example controller, according to the present disclosure.

FIG. 4 is a component diagram of an example controller 400. The controller 400 can include a processor 410. The processor 410 can receive signals (e.g., temperature signals from the first temperature sensor 310, second temperature sensor 340, or third temperature sensor 350, or pressure signals from the pressure sensor 355) and determine whether the valves (e.g., first EEV 250 and/or second EEV 255) should be adjusted to vary the refrigerant flow into condenser coil 230 and/or water heat exchanger 240. The processor 410 can include one or more of a microprocessor, microcontroller, digital signal processor, co-processor and/or the like or combinations thereof capable of executing stored instructions and operating upon data. The processor 410 can constitute a single core or multiple core processor that executes parallel processes simultaneously. For example, the processor 410 can be a single core processor that is configured with virtual processing technologies. The processor 410 can use logical processors to simultaneously execute and control multiple processes.

The controller 400 can include a memory 420. The memory 420 can be in communication with the one or more processors 410. The memory 420 can include instructions, for example a program 430 or other application, that causes the processor 410 and/or controller 400 to complete any of the processes described herein. For example, the memory 420 can include instructions that cause the controller 400 and/or processor 410 to receive input signals (e.g., pressure and/or temperature). The controller 400 and/or processor 410 can determine if the water temperature is below a predetermined value, the ambient air is above a predetermined temperature, and/or if the refrigerant leaving the evaporator coil 210 is below a predetermined pressure/temperature. The controller 400 and/or processor 410 can transmit output signals to the expansion valves to adjust refrigerant flow, as described herein. The memory 420 can include, in some implementations, one or more suitable types of memory (e.g., volatile or non-volatile memory, random access memory (RAM), read only memory (ROM), programmable read-only memory (PROM), erasable programmable read-only memory (EPROM), electrically erasable programmable read-only memory (EEPROM), magnetic disks, optical disks, floppy disks, hard disks, removable cartridges, flash memory, a redundant array of independent disks (RAID), and the like), for storing files including an operating system, application programs, executable instructions and data.

The controller 400 can be positioned proximate (e.g., attached to and/or within) the combined system 200. Nothing requires the controller 400 to be positioned near the combined system 200, however. That is, the controller 400 can be located remotely with respect to the combined system 200. The controller 400 can, for example, be integrated into a thermostat or another device (e.g., a computing device, a mobile device, etc.) located somewhere other than the location of the components of the combined system 200. The controller 400 can communicate with the various components of the combined system 200 or other heating ventilation and air conditioning (HVAC) systems with one or more input/output (I/O) devices 440. The I/O device 440 can include one or more interfaces for receiving signals or input from devices and providing signals or output to one or more devices that allow data to be received and/or transmitted by the controller 400. The I/O device 440 can facilitate wired or wireless connections with any of the components described herein, including the temperature sensors 310, 340, 350 or the pressure sensor 355.

Figure 5:
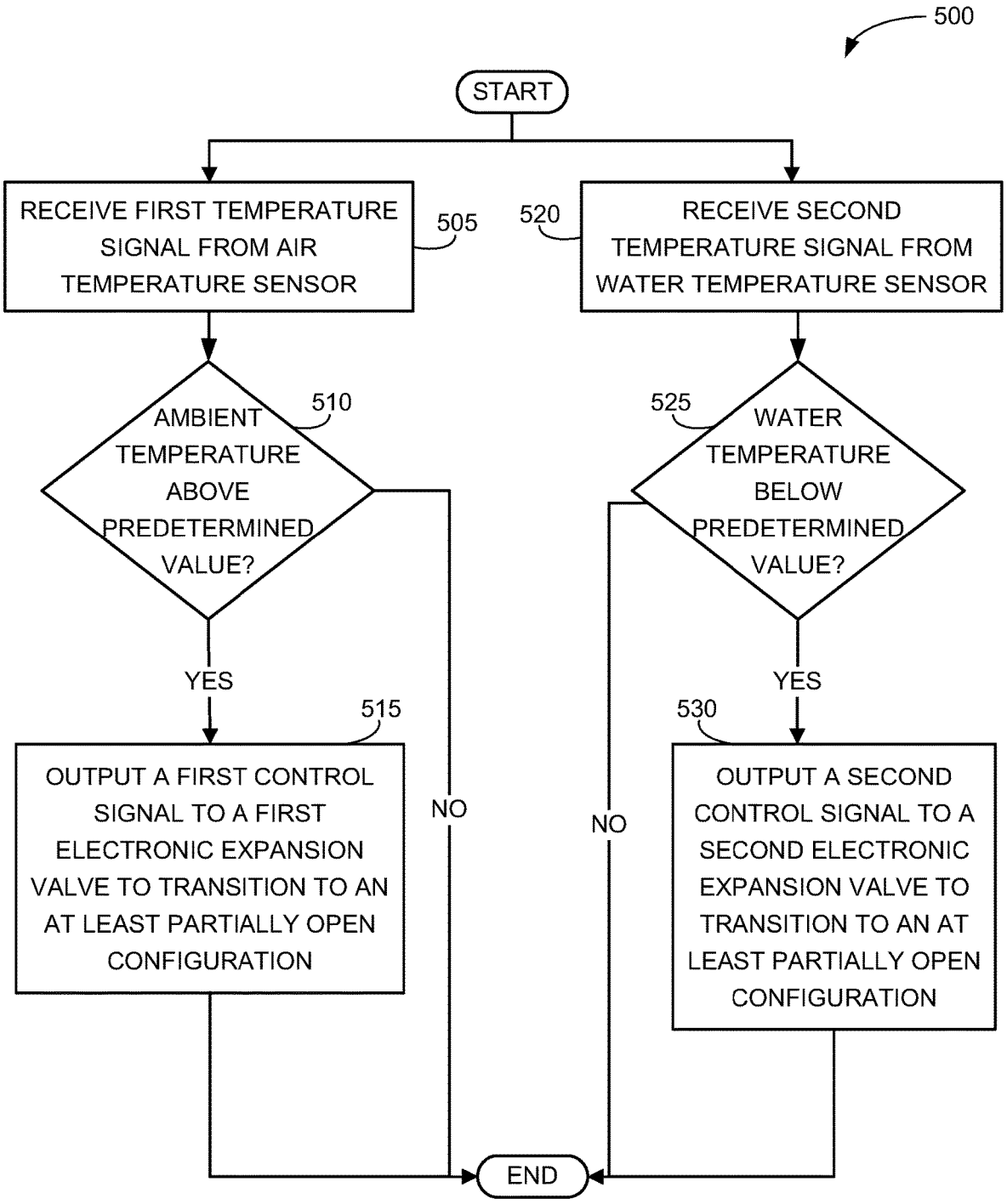
FIG. 5 is a flowchart of an example process for independently regulating air conditioning and water heating using electronic expansion valves, according to the present disclosure.

FIG. 5 is a flowchart showing an example process 500 for a controller, for example controller 400, according to some examples of the present disclosure. The process 500 described in FIG. 5 can be completed by the combined system 200 shown in FIGS. 2 and 3. Further the system described in FIG. 5 includes the second temperature sensor 340 (e.g., air temperature sensor) and the first temperature sensor 310 (e.g., water temperature sensor) described above.

Process 500 can begin at step 505, where the controller can receive an input signal from an ambient air temperature sensor (e.g., second temperature sensor 340). At step 510, the controller can determine, based on the data received from the ambient air temperature sensor, if the ambient air temperature is above a predetermined threshold temperature. To illustrate using an example, the predetermined threshold for the ambient air can be 70° F. If the temperature from ambient air temperature sensor reads the air temperature to be 70° or below, the controller 400 can identify that air conditioning is not in demand.

If the temperature of the ambient air is not greater than the predetermined threshold, process 500 can take no further action with respect to the air-conditioning circuit (e.g., the condenser coil 230/evaporator coil 210 circuit), but the controller 400 can continue to receive data from the ambient air temperature sensor. If the temperature of the ambient air is greater than the predetermined threshold, process 500 can proceed to step 515 which includes transmitting a first control signal to a first electronic expansion valve (e.g., first EEV 250) to at least partially open so as to permit refrigerant flow through the outside condenser coil 230.

For combined systems that also independently modulate hot water using the refrigerant circuit, process 500 can include step 520, where the controller 400 can receive an input signal from a water temperature sensor (e.g., first temperature sensor 310). At step 525, the controller 400 can determine, based on the data received from the water temperature sensor, if the water temperature within the water tank (e.g., water storage tank 245) is below a predetermined threshold. To illustrate using an example, the predetermined threshold for water stored in or exiting a water storage tank 245 can be 120° F. If the temperature from water temperature sensor reads the water temperature to be 120° or greater, the controller 400 can identify that hot water is not in demand. If the temperature is below 120°, then water heating can be determined to be in demand.

If the water temperature is greater than the predetermined threshold, process 500 can take no further action with respect to the water temperature circuit, but the controller 400 can continue to receive data from the water temperature sensor. If the water temperature is less than the predetermined threshold, process 500 can proceed to step 530 which includes transmitting a second control signal to a second electronic expansion valve (e.g., second EEV 255) to at least partially open so as to increase refrigerant flow into a water heat exchanger (e.g., water heat exchanger 240). This can provide needed heat, via high pressure, high temperature vaporized refrigerant, to heat the water in the storage tank. Process 500 can end after step 530. Alternatively, other processes can be completed according to the systems and methods described herein. Also, as described above, the systems and methods described herein are able to simultaneously provide heated water and air conditioning, meaning steps 505-515 and steps 520-530 can be performed simultaneously.

Certain examples and implementations of the disclosed technology are described above with reference to block and flow diagrams according to examples of the disclosed technology. It will be understood that one or more blocks of the block diagrams and flow diagrams, and combinations of blocks in the block diagrams and flow diagrams, respectively, can be implemented by computer-executable program instructions. Likewise, some blocks of the block diagrams and flow diagrams do not necessarily need to be performed in the order presented, can be repeated, or do not necessarily need to be performed at all, according to some examples or implementations of the disclosed technology. It is also to be understood that the mention of one or more method steps does not preclude the presence of additional method steps or intervening method steps between those steps expressly identified. Additionally, method steps from one process flow diagram or block diagram can be combined with method steps from another process diagram or block diagram. These combinations and/or modifications are contemplated herein.

It should also be noted that, as used in the specification and the appended claims, the singular forms "a," "an," and "the" include plural references unless the context clearly dictates otherwise. References to a composition containing "a" constituent is intended to include other constituents in addition to the one named.

Ranges may be expressed herein as from "about" or "approximately" or "substantially" one particular value and/or to "about" or "approximately" or "substantially" another particular value. When such a range is expressed, the range includes the one particular value and/or the other particular value (i.e., inclusive endpoints).

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

While the present disclosure has been described in connection with a plurality of exemplary aspects, as illustrated in the various figures and discussed above, it is understood that other similar aspects can be used, or modifications and additions can be made, to the described aspects for performing the same function of the present disclosure without deviating therefrom. For example, in various aspects of the disclosure, methods and compositions were described according to aspects of the presently disclosed subject matter. However, other equivalent methods or composition to these described aspects are also contemplated by the teachings herein. Therefore, the present disclosure should not be limited to any single aspect, but rather construed in breadth and scope in accordance with the appended claims.

The components described hereinafter as making up various elements of the disclosure are intended to be illustrative and not restrictive. Many suitable components that would perform the same or similar functions as the components described herein are intended to be embraced within the scope of the disclosure. Such other components not described herein can include, but are not limited to, for example, similar components that are developed after development of the presently disclosed subject matter. Additionally, the components described herein may apply to any other component within the disclosure. Merely discussing a feature or component in relation to one embodiment does not preclude the feature or component from being used or associated with another embodiment.

What is claimed is:

1. A combined air-cooling and water-heating system comprising:

a first electronic expansion valve in fluid communication with a condenser coil at a first end and an evaporator coil at a second end, the first electronic expansion valve configured to transition between an open configuration, a closed configuration, and an intermediate configuration between the open configuration and the closed configuration;

a second electronic expansion valve in fluid communication with a water heat exchanger at a first end and the evaporator coil at a second end, the second electronic expansion valve configured to transition between an open configuration, a closed configuration, and an intermediate configuration between the open configuration and the closed configuration; and a controller configured to output one or more control signals to the first electronic expansion valve and the second electronic expansion valve to transition the respective valves between the open and closed configurations, wherein the controller is configured to output a first control signal of the one or more control signals in response to determining that an ambient air temperature is above a predetermined temperature, the first control signal instructing the first electronic expansion valve to open at least partially while the second electronic expansion valve is at least partially open, and wherein heated refrigerant is provided to the condenser coil and to the water heat exchanger by the evaporator coil while the first electronic expansion valve and the second electronic expansion valve are both at least partially open.

2. The combined air-cooling and water-heating system of claim 1 further comprising a temperature sensor configured to detect the ambient air temperature and output a temperature signal indicative of the ambient air temperature to the controller, wherein at least partially opening the first electronic expansion valve increases refrigerant flow through the condenser coil.

3. The combined air-cooling and water-heating system of claim 1, wherein the controller is configured to output a second control signal to the second electronic expansion valve in response to an increased demand for hot water.

4. The combined air-cooling and water-heating system of claim 3, further comprising a temperature sensor configured to detect water temperature of a water storage tank and output a temperature signal to the controller, wherein the controller is configured to output the second control signal further in response to determining the water temperature is below a predetermined temperature, the second control signal instructing the second electronic expansion valve to open at least partially, and wherein at least partially opening the second electronic expansion valve increases refrigerant flow through the water heat exchanger.

5. The combined air-cooling and water-heating system of claim 1 further comprising:

a compressor in fluid communication with (i) the evaporator coil at a first end and (ii) the condenser coil and the water heat exchanger at a second end; and a temperature sensor positioned within a refrigerant circuit between the evaporator coil and the compressor and configured to:

detect a temperature of a refrigerant exiting the evaporator coil; and output a temperature signal to the controller in response to the temperature of the refrigerant being below a predetermined temperature, wherein the one or more control signals are configured to transition at least one of the first electronic expansion valve or the second electronic expansion valve to an at least partially open configuration to increase the temperature of the refrigerant exiting the evaporator coil.

6. The combined air-cooling and water-heating system of claim 5 further comprising:

a pressure sensor positioned within the refrigerant circuit between the evaporator coil and the compressor and configured to:

detect a pressure of the refrigerant exiting the evaporator coil; and output a pressure signal to the controller in response to the pressure of the refrigerant being below a predetermined value, wherein the one or more control signals are configured to transition at least one of the first electronic expansion valve or the second electronic expansion valve to an at least partially open configuration to increase the pressure of the refrigerant exiting the evaporator coil.

7. The combined air-cooling and water-heating system of claim 1 further comprising a compressor in fluid communication with (i) the evaporator coil at a first end and (ii) the condenser coil and the water heat exchanger at a second end, wherein a refrigerant flow path between the compressor and the condenser coil and the water heat exchanger includes a valve-free splitter.

8. The combined air-cooling and water-heating system of claim 1, wherein the first electronic expansion valve and the second electronic expansion valve are both at least partially open during an air conditioning operation when the ambient temperature is above the predetermined temperature.

9. A water heating and air conditioning system comprising:

a compressor;

an evaporator coil;

a condenser coil in fluid communication with the compressor at a first end the evaporator coil at a second end;

a water heat exchanger in fluid communication with the compressor at a first end the evaporator coil at a second end;

a first electronic expansion valve disposed in series between the condenser coil and the evaporator coil;

a second electronic expansion valve disposed in series between the water heat exchanger and the evaporator coil; and a controller configured to output one or more control signals to the first electronic expansion valve and/or the second electronic expansion valve to transition the respective electronic expansion valve between open and closed configurations in response to at least one of an increased demand for air conditioning or an increased demand for water heating, wherein the first electronic expansion valve and the second electronic expansion valve are independently transitionable between open and closed configurations or any intermediate point therebetween such that refrigerant flow through at least one of the condenser coil or water heat exchanger is independently regulatable, wherein a first control signal of the one or more control signals is configured to cause the first electronic expansion valve to open at least partially when an ambient air temperature is above a predetermined temperature and when the second electronic expansion valve is at least partially open, and wherein heated refrigerant is provided to the condenser coil and to the water heat exchanger by the evaporator coil while the first electronic expansion valve and the second electronic expansion valve are both at least partially open.

10. The system of claim 9 further comprising a temperature sensor configured to detect the ambient air temperature and output a temperature signal indicative of the ambient air temperature to the controller, wherein at least partially opening the first electronic expansion valve increases refrigerant flow through the condenser coil.

11. The system of claim 9 further comprising:

a water storage tank; and a first temperature sensor configured to detect water temperature of the water storage tank and output a first temperature signal to the controller, wherein a second control signal of the one or more control signals is configured to cause the second electronic expansion valve to open at least partially when the water temperature is below a first predetermined temperature, and wherein at least partially opening the second electronic expansion valve increases refrigerant flow through the water heat exchanger.

12. The system of claim 11, wherein the first temperature sensor is positioned at a water outlet of the water storage tank.

13. The system of claim 11 further comprising a second temperature sensor configured to detect the ambient air temperature and output a second temperature signal indicative of the ambient air temperature to the controller, wherein at least partially opening the first electronic expansion valve increases refrigerant flow through the condenser coil.

14. The system of claim 13 further comprising a third temperature sensor positioned within in series between the evaporator coil and the compressor and configured to:

detect a refrigerant temperature of a refrigerant exiting the evaporator coil; and output a third temperature signal to the controller in response to the refrigerant temperature being below a third predetermined temperature, wherein a third control signal of the one or more control signals is configured to transition at least one of the first electronic expansion valve or the second electronic expansion valve to an at least partially open configuration to increase the temperature of the refrigerant exiting the evaporator coil.

15. The system of claim 14 further comprising a pressure sensor positioned in series between the evaporator coil and the compressor and configured to:

detect a refrigerant pressure exiting the evaporator coil; and output a pressure signal to the controller in response to the pressure of the refrigerant being below a predetermined value, wherein a fourth control signal of the one or more control signals is configured to transition at least one of the first electronic expansion valve or the second electronic expansion valve to an at least partially open configuration to increase the pressure of the refrigerant exiting the evaporator coil.

16. The system of claim 11, wherein a flow path in a refrigerant circuit between (i) the compressor and (ii) the condenser coil and the water heat exchanger includes a valve-free splitter.

17. The system of claim 9, wherein the first electronic expansion valve and the second electronic expansion valve are both at least partially open during an air conditioning operation when the ambient temperature is above the predetermined temperature.

18. A controller for a combined water heating and air conditioning system comprising:

a processor;

memory in communication with the processor and storing instructions that, when executed by the processor, cause the controller to:

receive, from a first temperature sensor, a first temperature signal indicating an ambient air temperature in a space is above a first predetermined temperature;

output a first control signal to a first electronic expansion valve to transition to an at least partially open configuration when a second electronic expansion valve is at least partially open, thereby causing refrigerant flow through a condenser coil to increase;

receive, from a second temperature sensor, a second temperature signal indicating a water temperature of water stored in a water storage tank is below a second predetermined temperature; and output a second control signal to the second electronic expansion valve to transition to an at least partially open configuration when the first electronic expansion valve is at least partially open, thereby causing refrigerant flow through a water heat exchanger to increase, wherein heated refrigerant is provided to the condenser coil and to the water heat exchanger by an evaporator coil while the first electronic expansion valve and the second electronic expansion valve are both at least partially open.

19. The controller of claim 18, wherein the instructions further cause the controller to:

receive, from the first temperature sensor, a third temperature signal indicating that the ambient air temperature is equal to or less than the first predetermined temperature; and output a third control signal to the first electronic expansion valve to transition to an at least partially closed configuration, thereby causing refrigerant flow through the condenser coil to decrease.

20. The controller of claim 19, wherein the instructions further cause the controller to:

receive, from the second temperature sensor, a fourth temperature signal indicating that the water temperature is equal to or greater than the second predetermined temperature; and output a fourth control signal to the second electronic expansion valve to transition to an at least partially closed configuration, thereby causing refrigerant flow through the water heat exchanger to decrease.

* * * * *